US010290931B1

(12) United States Patent
Judd

(10) Patent No.: US 10,290,931 B1
(45) Date of Patent: May 14, 2019

(54) LEADING EDGE ANTENNA STRUCTURES

(71) Applicant: Judd Strategic Technologies, LLC, Rockwall, TX (US)

(72) Inventor: Mano D. Judd, Heath, TX (US)

(73) Assignee: Mano D. Judd, Heath, TX (US)

( * ) Notice: Subject to any disclaimer, the term of this patent is extended or adjusted under 35 U.S.C. 154(b) by 329 days.

(21) Appl. No.: 15/342,760

(22) Filed: Nov. 3, 2016

(51) Int. Cl.

| | |
|---|---|
| ***H01Q 1/02*** | (2006.01) |
| ***H01Q 1/28*** | (2006.01) |
| ***H01Q 15/14*** | (2006.01) |
| ***H01Q 19/30*** | (2006.01) |

(52) U.S. Cl.
CPC ..... *H01Q 1/287* (2013.01); *H01Q 1/02* (2013.01); *H01Q 15/14* (2013.01); *H01Q 19/30* (2013.01)

(58) Field of Classification Search
CPC ..... H01Q 1/28; H01Q 1/286; H01Q 1/287; H01Q 1/30; H01Q 15/14; H01Q 15/18; H01Q 19/30
See application file for complete search history.

(56) References Cited

U.S. PATENT DOCUMENTS

| | | | | |
|---|---|---|---|---|
| 4,514,734 A * | 4/1985 | Cermignani | ..... | H01Q 1/286 343/708 |
| 4,749,997 A * | 6/1988 | Canonico | ..... | H01Q 1/287 343/705 |
| 4,912,477 A * | 3/1990 | Lory | ..... | H01Q 1/287 342/372 |

* cited by examiner

*Primary Examiner* — Robert Karacsony

(57) ABSTRACT

An apparatus and method are described for a leading and trailing edge antenna structure. The antenna disclosed, with optional director and reflector, can allow for greater RF and telecommunications capabilities on an aircraft, including operating at lower frequencies than previous solutions. The disclosure allows for greater capability with negligible effect on weight or drag of an aircraft.

20 Claims, 12 Drawing Sheets

LEADING EDGE ANTENNA STRUCTURES

TECHNICAL FIELD

The present disclosure is directed to antennas for aircraft, and more particularly to leading edge antennas.

BACKGROUND OF THE INVENTION

Aircraft need antennas for a variety of reasons. One purpose is to communicate with other aircraft or with airports or other entities on the ground. Antennas can be located in various locations on a plane, such as the under belly, the tail fin, or the nose. Some of these antennas can comprise metallic structures that stick out from the body of the aircraft.

BRIEF SUMMARY OF THE INVENTION

One possible embodiment of the present disclosure comprises an aircraft wing comprising: a spar; an antenna reflector located forward of the spar and extending away from the spar; an antenna surface located forward of the antenna reflector and extending away from the antenna reflector; an antenna attached to the antenna surface and substantially conformal to the antenna surface; a dielectric surface located forward of the antenna surface and extending away from the antenna surface; and an antenna director attached to the dielectric surface and substantially conformal to the dielectric surface.

Another possible embodiment comprises an aircraft wing comprising: a spar; a leading edge antenna structure comprising; a first antenna reflector located forward of the spar and extending away from the spar; a first antenna surface located forward of the first antenna reflector and extending away from the antenna reflector; a first antenna attached to the first antenna surface and substantially conformal to the first antenna surface; a first dielectric surface located forward of the first antenna surface and extending away from the first antenna surface; and a first antenna director attached to the first dielectric surface and substantially conformal to the first dielectric surface; and a trailing edge antenna structure comprising; a second antenna reflector located aft of the spar and extending away from the spar; a second antenna surface located aft of the second antenna reflector and extending away from the second antenna reflector; a second antenna attached to the second antenna surface and substantially conformal to the second antenna surface; a second dielectric surface located aft of the second antenna surface and extending away from the second antenna surface; and a second antenna director attached to the second dielectric surface and substantially conformal to the second dielectric surface.

Another possible embodiment comprises a method for constructing a leading edge antenna structure on a wing of an aircraft, the method comprising: providing a wing spar interior to the wing; attaching an antenna reflector to the interior of the wing on the fore side of the wing spar; attaching an antenna surface to the interior of the wing on the fore side of the antenna reflector, the antenna surface having a concave shape open toward the aft of the aircraft; attaching an antenna to at least a portion of the antenna surface; attaching a dielectric surface to the interior of the wing on the fore side of the antenna surface, the dielectric surface having a concave shape open toward the aft of the aircraft; and attaching an antenna director to at least a portion of the dielectric surface.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Many prior art aircraft antennas create drag on an aircraft. For instance, any structure protruding from an aircraft works to add more drag and detract from an aircraft's aerodynamic qualities and efficiency. Some antennas can also add substantial weight, especially if the number of individual antennas is high. One object of the present disclosure is to provide antenna structures for aircraft that minimize detrimental effects on drag and weight.

Figure 1:
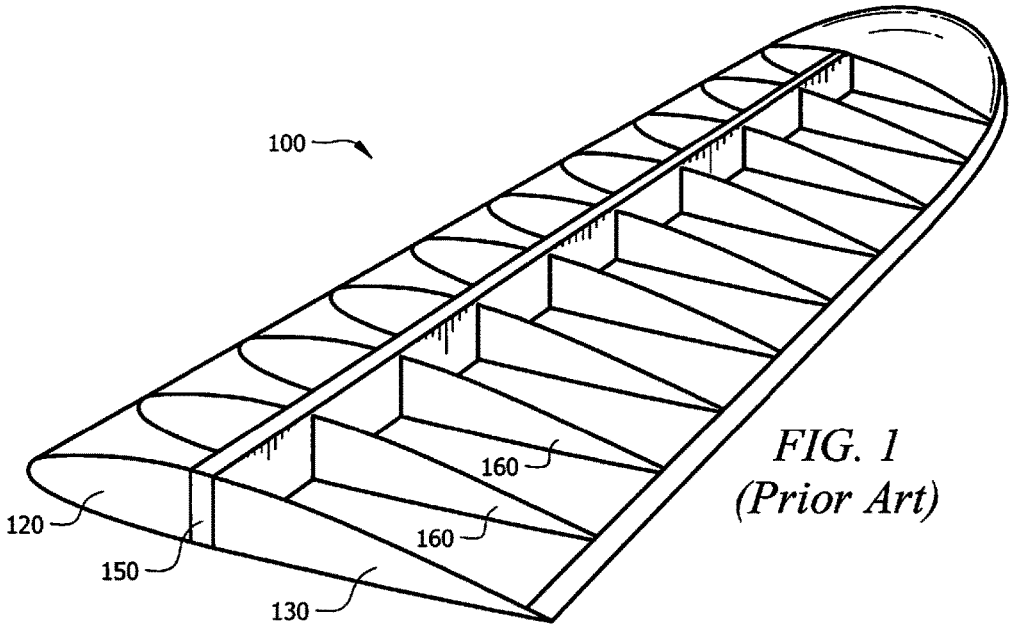
FIG. 1 (Prior Art)
FIG. 1 is a diagram of a prior art wing embodiment.

Referring now to FIG. 1, a partially see-through wing 100 of an aircraft is shown. Wing 100 is typical of wing construction. Wing 100 comprises a leading edge 120, a spar 150, trailing edge 130, and ribs 160. Spar 150 provides the main structural support for the wing 100. Other wings can comprise multiple spars. Sometimes fuel is stored in the wing. In such embodiments there may be storage cavities/tanks within the spar(s) or within the wing. Electronics, sensors, and cables may also be disposed within the wing. One object of the present disclosure is to integrate antennas into the leading edges (and/or the trailing edges) of the wings of aircraft. In this way, leading edges can provide both antenna structures and support structure for wings. Such a solution allows antennas to have negligible effects on drag and weight.

Figure 2:
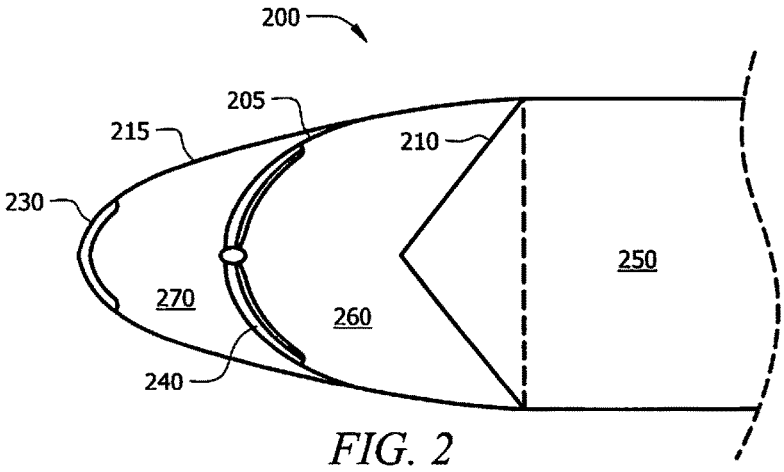
FIG. 2 is a diagram of an antenna embodiment under the present disclosure.

FIG. 2 shows a possible embodiment of a leading edge 200 under the current disclosure. The leading edge 200 can comprise elements of a wing that are fore of the spar 250. As shown in FIG. 2, the leading edge 200 comprises a reflector 210, a dual pol antenna 240, and a director 230. The space 260 between the reflector 210 and the antenna 240 will typically comprise air (or another fluid). The space 270 between the antenna 240 and the director 230 can comprise a dielectric, foam, air, or fluid (or anything that is non-conductive). The surface 205, upon which the antenna 240 is located can comprise a dielectric. Surface 215 upon which the director 230 is located can comprise a metal or a dielectric.

Viewed from the front of the plane, the director 230 and antenna 240 will repeat along the leading edge of a wing, roughly from wing tip to wing tip (though they may not be visible to the naked eye). Neighboring directors 230 and antennas 240 can be spaced closely or further apart, depending on cost issues, or transmission needs of a user. The structures of FIG. 2 can be integrated into multiple wings or fins on an aircraft. Typically, the most forward element (director 230, surface 215, antenna 240, or surface 205) will match the shape desired for the wing's leading edge. In other embodiments the most forward element will not comprise the shape of the leading edge and will be located interior to the wing. In trailing edge embodiments, these elements may or may not comprise the trailing edge and can be interior to the wing.

Director 230 can comprise a cross shape in a preferred embodiment. In other embodiments the director can comprise a single straight line, either vertical or horizontal. Directors will typically be similar in size or smaller than the antenna 240. Some embodiments under the present disclosure will not comprise any directors. Director 230 can comprise a metal etched onto a surface 215, or otherwise integrated or printed onto the surface 215. Director 230 can be disposed on either the interior or exterior edge of surface 215. Director 230 can help to increase gain of antenna 240. An increase in gain of 5 to 10 dBi is typically seen. FIG. 2 shows a director 230 on a surface 215. Some embodiments will comprise a director over the entire surface 215 such that the director 230 and surface 215 are really one element. Director 230 and surface 215 can take a concave shape open toward the aft of the aircraft. Director 230 and surface 215 can have other shapes as desired. In a preferred embodiment, the surface 215 will at least substantially comprise the front or leading edge of the wing.

In some embodiments the reflector 210 is integrated into the spar 250 such that they are one material. In other embodiments the reflector 210 can be attached to spar 250, or otherwise disposed in a wing. Reflector 210 can comprise a solid mass of material, or reflector 210 can comprise a hollow extension or shell. Reflector 210 can be triangular, rounded, squared, or any appropriate shape. Reflector 210 can be excluded in some embodiments. Other embodiments can comprise multiple reflectors. Reflector 210 will preferably comprise a metal or a metalized dielectric (plastic, fiberglass, etc.). Other materials may be possible depending on user needs. Reflector 210 can be triangle shaped, circular, rounded or another shape, with a base against the wing spar, or another wing structure. Reflector 210 can also take a concave shape and open toward the aft of the aircraft. Reflector 210 can have other shapes as desired. Reflector 210 can extend along the length of the spar, or reflector 210 can be positioned only behind antennas 240. Similarly, the antenna 240 and director 230 can extend along the wing for short or long spans. For example, a single antenna can be only several inches wide and be separated from a neighboring antenna. However, some embodiments can comprise a single antenna extending along the entire wing or spar length (as seen from the front or back of an aircraft). Directors 230 and reflectors 210 can comprise multiple, spaced apart elements, or elements that extend along the entire spar or wing.

Embodiments that exclude directors 230 and reflectors 210 allow antennas 240 to have a more 360° view for signal transmission and reception.

Antenna 240 will typically be a dual polarization ("dual pol") antenna but can comprise any of a variety of conformal antennas, including various single polarization antennas. One type of possible antenna is any of the antennas disclosed in U.S. patent application Ser. No. 15/210,583, titled "Dual Polarization Antenna" (herein incorporated by reference in its entirety). Antenna 240 can comprise a metal etched onto a surface 205, or otherwise integrated or printed onto the surface 205. Antenna 240 can be disposed on either the interior or exterior edge of surface 205. Antenna 240 can comprise leads, wiring, and other connections or elements typically comprising antennas. Antenna 240 can extend along the entire edge 205, or can comprise a smaller portion. The curved shape of antenna 240 allows it to have functionality at a lower frequency than prior art antennas that might be placed roughly vertically on the side of an aircraft body. FIG. 2 shows a director 240 on a surface 205. Some embodiments will comprise an antenna over the entire surface 205 such that the director 240 and surface 205 are really one element. Antenna 240 can take a concave shape and open toward the aft of the aircraft. Antenna 240 can have other shapes as desired.

The director 230, antenna 240, and reflector 210 can take a variety of shapes. As shown in FIG. 2, the profile shape can vary. Reflector 210 can have a triangular shape, or another shape. Antenna 240 can be curved or triangular. Director 230 can be curved or approximately triangular. The shape of any or all of these elements may be limited by the aerodynamic needs that go into designing the wings of the aircraft. Antennas, directors, and reflectors that are disposed on other wings or fins of the aircraft can vary in shape as well.

The distance between the reflector 210 and the antenna 240/surface 205, and between the antenna 240/surface 205 and director 230/surface 215, can vary. Some benefits have been observed when the distance is approximately 0.15λ to 0.25λ. However, other distances can be used, such as 1/50th to 1/10 the length of the chord. Distances longer or shorter can be used if desired by a user.

During construction of a wing such as wing 200, the reflector 210 can be attached to the spar, the surface 205 attached at its ends to the ends of the reflector 210, and the surface 215 attached at its ends to the ends of the surface 205. In other embodiments the elements can be spaced apart by structures or surfaces of the wing. Wings can be constructed of dielectrics, metals, metalized plastics, and more. The antenna 240, director 230, reflector 210, surface 205, and surface 215 can be connected to the wing and avoid contact with each other. They can also be attached to each other in some embodiments. In most embodiments it will be desired to prevent the metal portions of antennas 240 and directors 230 from coming into contact with any other metal. In such embodiments, antennas 240 and directors 230 may be prevented from covering the entire periphery of surfaces 205 and 215. It may be possible in some embodiments to cover the entire periphery but still prevent metal to metal contact.

Figure 3:
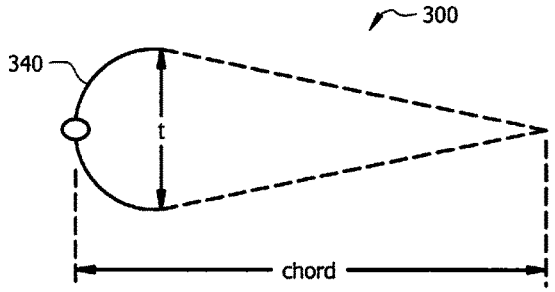
FIG. 3 is a diagram of an antenna embodiment under the present disclosure.

Referring to FIG. 3, with continuing reference to FIG. 2, it can be seen how a leading edge embodiment of the present disclosure can offer improved performance. FIG. 3 shows a cross section of an aircraft wing 300 with a height t and a length chord (ch). Wing 300 has a leading edge antenna 340. For most aircraft the relation between t and ch is t/ch≈0.10 to 0.18 (though this can change for certain types of aircraft). Antenna 340 has a length L which is roughly half the circumference of a circle defined with a diameter t. L is therefore roughly 0.5*π*t. Assuming π≈3, antenna 340 has a length L approximately 1.5 times the length t. Antenna 340 therefore has greater functionality at longer wavelength and lower frequency transmission than an antenna with a height oft. Antenna 340 therefore has greater capabilities than antennas that might be placed flat on an aircraft body with a height t.

To give an example of wavelength and frequency for a possible antenna embodiment under the present disclosure, we can assume a chord of 5 feet, and ratio t/ch of 0.18. In this scenario, L=0.5*π*0.18*5 ft.=1.4136 ft.=0.431 meters. This antenna would have a longer length than a flat planar antenna of height t. Relating L to wavelength and frequency can depend on various factors. However, for wideband antennas used in embodiments under the present disclosure, it has been found that L relates to wavelength roughly by L=0.3*λ. For L=0.431 m, then λ=0.431/0.3=1.436 m. Relating to frequency (λ*f=c (speed of light)), yields $f_{min}$=214 Mhz. This is a lower frequency than that achievable by an antenna of height t. For situations of ISR (intelligence surveillance reconnaissance), $ISR_{min}$=(¼)*$f_{min}$=53.5 Mhz. Different embodiments with different chord length, different t (or ratio t/ch), will yield different operational wavelength and frequency. But in all cases, a leading edge antenna under the present disclosure yields a lower operational frequency than a generally flat and vertically planar antenna of height t.

Figure 4:
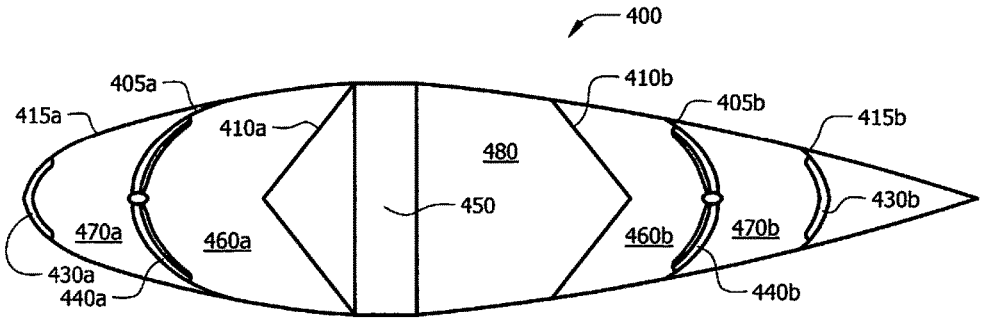
FIG. 4 is a diagram of an antenna embodiment under the present disclosure.

FIG. 4 displays a possible embodiment under the present disclosure. Wing 400 comprises a leading edge antenna 440*a*, director 430*a*, reflector 410*a* and a trailing edge antenna 440*b*, director 430*b*, and reflector 410*b*. Other elements include spaces 460*a*, 460*b*, 470*a*, 470*b*, and surfaces 405*a*, 405*b*, 415*a*, 415*b*. Spar 450 is aft of the reflector 410*a*. Cavity 480 can be used for storing fuel. Space 270*a* can double as a de-icing cavity 270*a*. De-icing typically involves directing heated air from in and around the engine to a cavity 270*a* along the leading edge to melt ice. FIG. 4 displays how embodiments can comprise trailing edge antenna structures in addition to leading edge antenna structures. Also shown is how spar, fuel cavities, and de-icing cavities can be integrated into a wing with the leading edge and trailing edge antennas, directors, and reflectors. Other embodiments could comprise antennas, directors, and reflectors only on the trailing edge, and not on the leading edge. Antennas also can be incorporated without the use of directors and/or reflectors. Multiple reflectors can be used on either or both the leading and trailing edges.

Figure 5A:
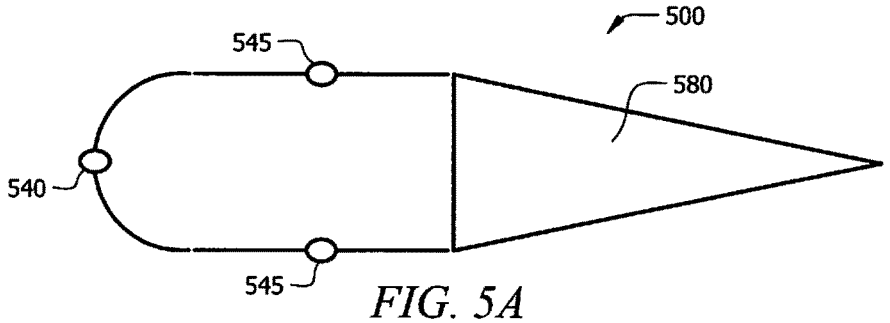
FIGS. 5A and 5B are diagrams of antenna embodiments under the present disclosure.
Figure 5B:
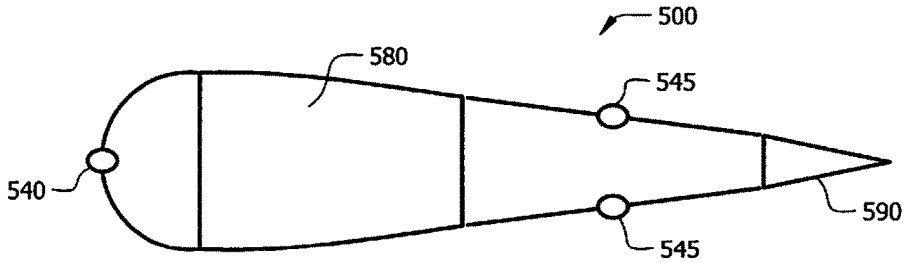

FIGS. 5A and 5B show wing construction embodiments using additional antennas. In FIG. 5A a wing 500 comprises a leading edge antenna 540, aft antennas 545, and section 580 that houses structure and fuel storage. FIG. 5B shows a wing 500 with leading edge antenna 540, section 580 for fuel and structure, aft antennas 545, and trailing edge 590. In each FIGS. 5A and 5B the aft antennas and the leading edge antenna can be coupled together or coupled to a transmission and reception electronics and software elsewhere in the aircraft. The aft antennas can assist in vertical pattern coverage to the leading edge antenna. The top aft antenna 545 can have vertical polarities of +45° to +90°. The bottom aft antenna 545 can have vertical pattern coverage of −45° to −90°. The leading edge antenna 540 will have a polarity of −45°≤ϕ≤45°.

Figure 6:
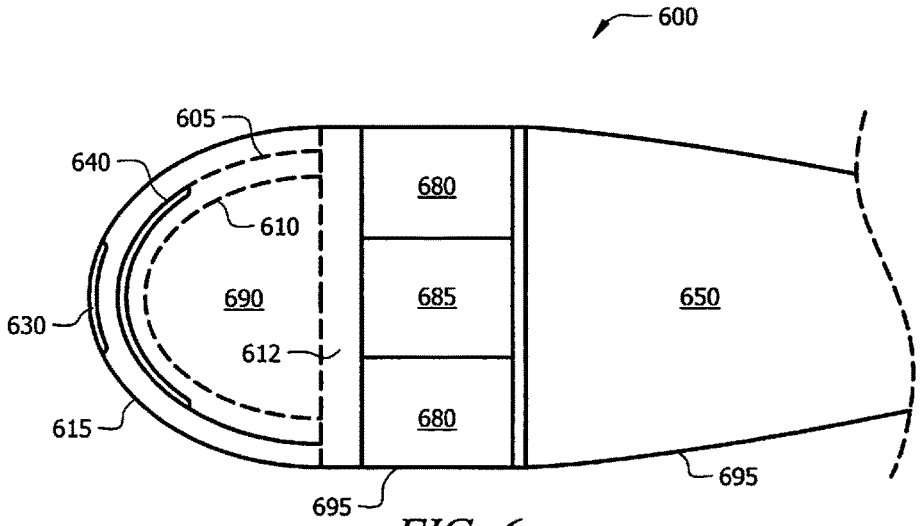
FIG. 6 is a diagram of an antenna embodiment under the present disclosure.

FIG. 6 shows a further possible embodiment of a wing 600 and antenna structures under the present disclosure. Wing 600 comprises a director 630 on surface 615, antenna 640 on surface 605, and reflector 610. Aft of the reflector 610 is an absorber 612, power amplifiers 680, and cable routing 685. Amplifiers 680 and cable routing 685 provide electrical connections and power to antenna structures and other components on the wing, such as lights, slats, flaps, scoops, or other components. Cavity 690 can provide de-icing functionality with bleed air from the engine. Fuel space 650 can house fuel. Reflector 610 can comprise a frequency selective surface (FSS). Surface 615 can comprise conformal load bearing antenna structure (CLAS) and/or FSS ground planes and absorbers. Surface 695 surrounding the space 650 and amplifiers 680 can comprise a metal composite which can comprise radiation absorbent material (RAM).

Figure 7:
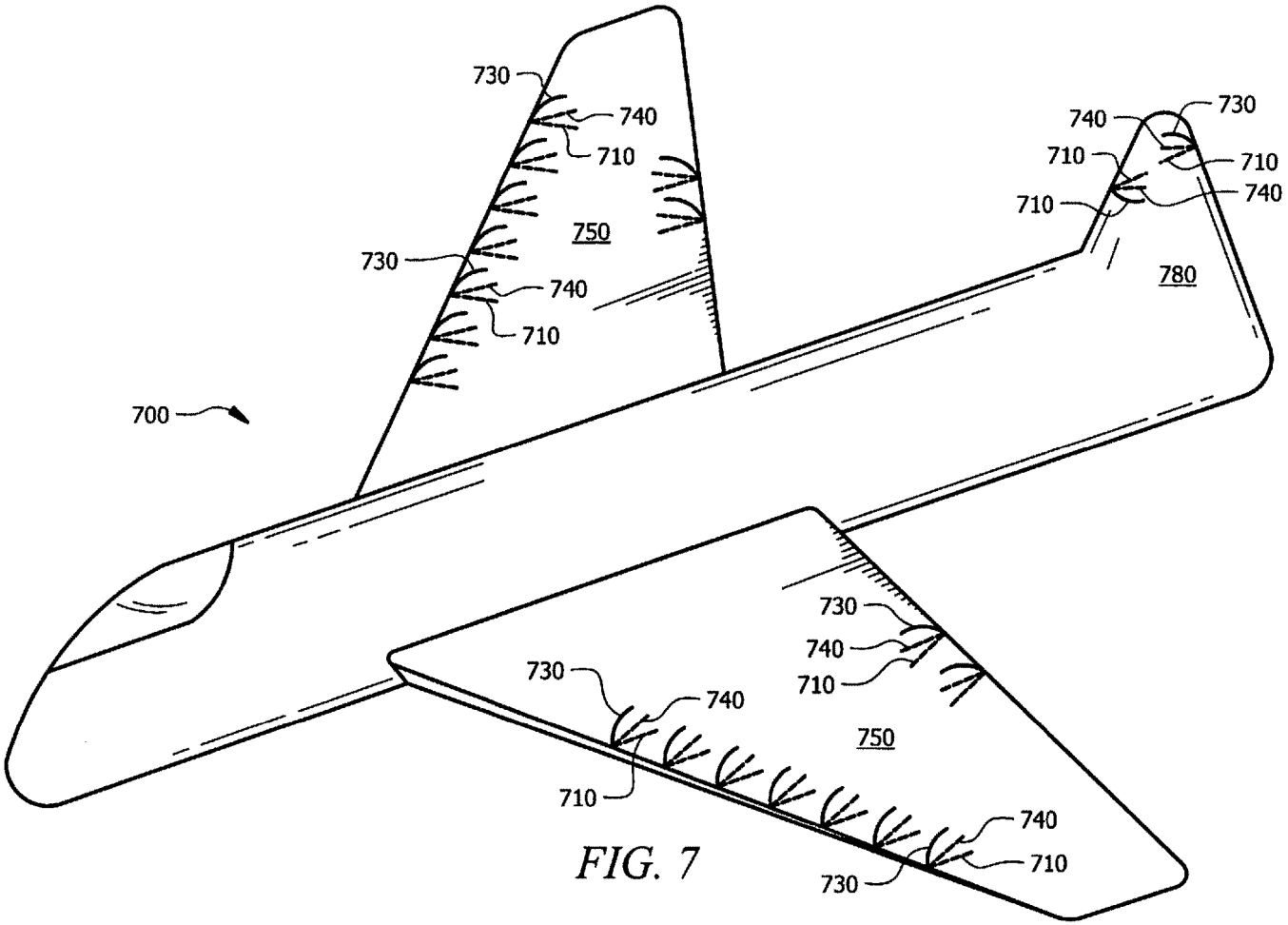
FIG. 7 is a diagram of an aircraft embodiment under the present disclosure.

FIG. 7 displays a possible embodiment of a plane under the present disclosure. Plane 700 comprises wings 750. Each wing 750 comprises a plurality of antennas 740, directors 730, and reflectors 710 on both the leading and trailing edges. Fin 780 can also comprise an antenna 740, directors 730, and reflector 710. Plane 700 can also comprise additional wings or fins, each comprising antennas 740, directors 730, reflectors 710 on leading and/or trailing edges. In some instances the directors 730 and/or reflectors 710 will be excluded.

Figure 8:
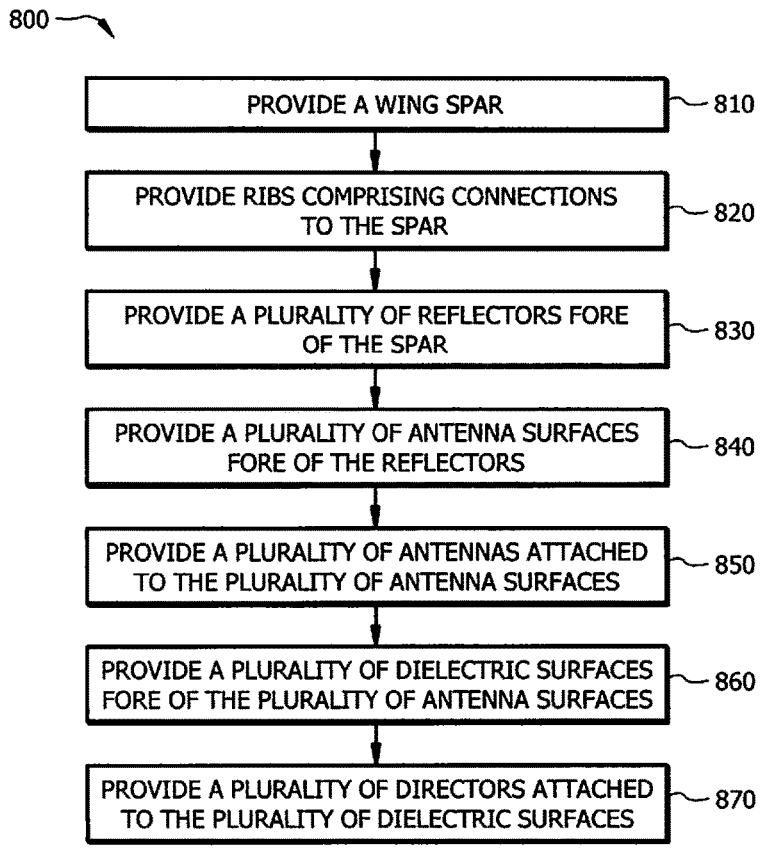
FIG. 8 is a flow-chart diagram of a method embodiment under the present disclosure.

FIG. 8 displays a method embodiment 800 for constructing a wing for an aircraft under the present disclosure. At step 810, a wing spar is provided. At 820, ribs are provided that connect to the spar. At 830, a plurality of reflectors are provided fore of the spar. At 840 a plurality of antenna surfaces are provided fore of the reflectors. At 850, a plurality of antennas are attached to the plurality of antenna surfaces. At 860, a plurality of dielectric surfaces are provided fore of the plurality of antenna surfaces. At 870, a plurality of directors are attached to the plurality of dielectric surfaces.

Some method embodiments under the present disclosure can comprise the creation of the wing spar and then the antenna structures (antenna, director, reflector, surfaces), followed by creating the exterior of the wing. Other embodiments can comprise creating a wing spar and wing exterior, followed by the addition of antenna structures within the wing. In some embodiments the antenna structures will comprise the exterior surface of a wing.

Figure 9:
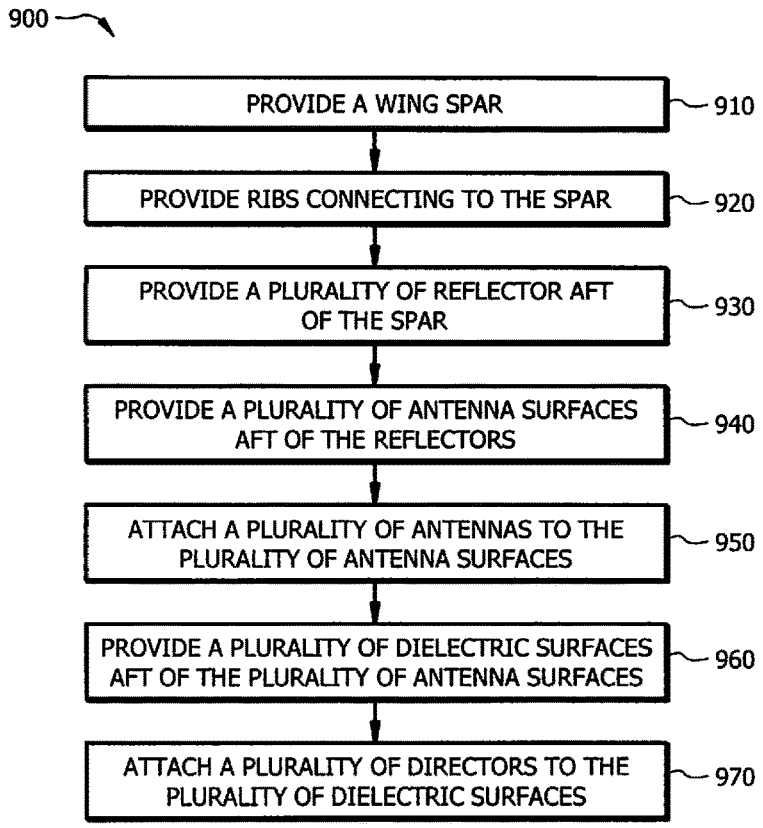
FIG. 9 is a flow-chart diagram of a method embodiment under the present disclosure.

FIG. 9 displays a method embodiment 900 for constructing a wing for an aircraft under the present disclosure. In this embodiment the antenna structures are for a trailing edge antenna. At step 910, a wing spar is provided. At 920, ribs are provided that connect to the spar. At 930, a plurality of reflectors are provided aft of the spar. At 940 a plurality of antenna surfaces are provided aft of the reflectors. At 950, a plurality of antennas are attached to the plurality of antenna surfaces. At 960, a plurality of dielectric surfaces are provided aft of the plurality of antenna surfaces. At 970, a plurality of directors are attached to the plurality of dielectric surfaces. Methods 800 and 900 can be combined to create a wing with both leading edge and trailing edge antennas.

Figure 10:
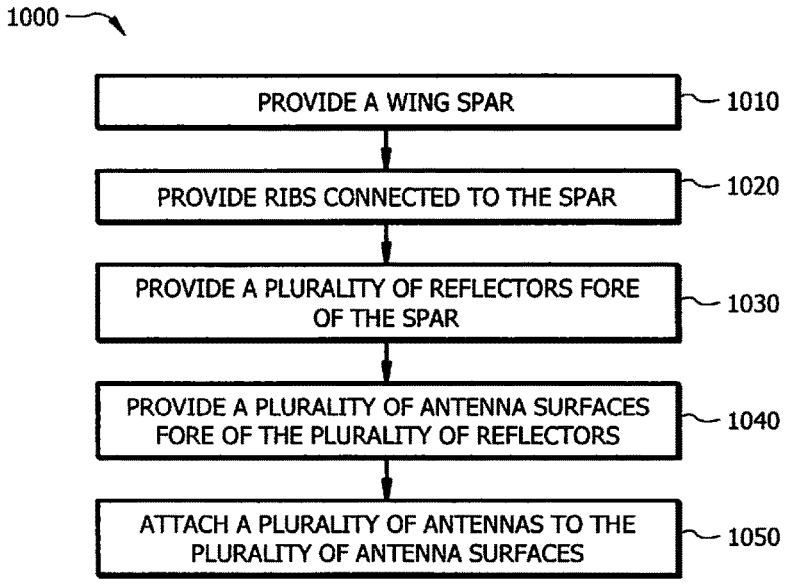
FIG. 10 is a flow-chart diagram of a method embodiment under the present disclosure.

FIG. 10 displays a method embodiment 1000 for constructing a wing for an aircraft under the present disclosure. At step 1010, a wing spar is provided. At 1020, ribs are provided that connect to the spar. At 1030, a plurality of reflectors are provided fore of the spar. At 1040 a plurality of antenna surfaces are provided fore of the reflectors. At 1050, a plurality of antennas are attached to the plurality of antenna surfaces. A similar method embodiment to method 1000 can be carried out for a trailing edge antenna structure.

Figure 11:
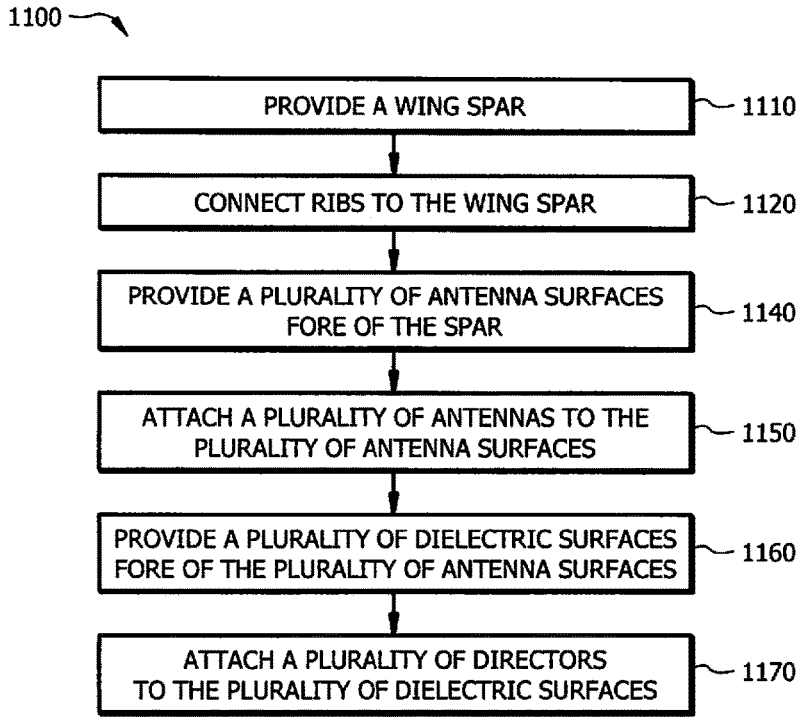
FIG. 11 is a flow-chart diagram of a method embodiment under the present disclosure.

FIG. 11 displays a method embodiment 1100 for constructing a wing for an aircraft under the present disclosure. At step 1110, a wing spar is provided. At 1120, ribs are provided that connect to the spar. At 1140 a plurality of antenna surfaces are provided fore of the spar. At 1150, a plurality of antennas are attached to the plurality of antenna surfaces. At 1160, a plurality of dielectric surfaces are provided fore of the plurality of antenna surfaces. At 1170, a plurality of directors are attached to the plurality of dielectric surfaces. A similar method embodiment to method 1100 can be carried out for a trailing edge antenna structure.

Figure 12:
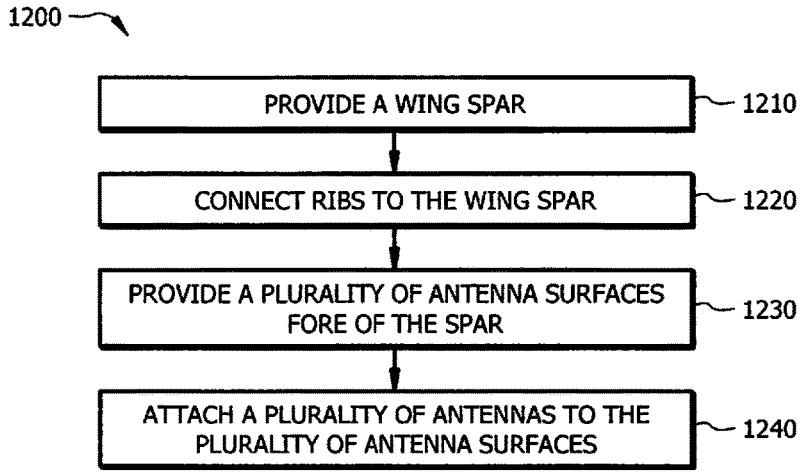
FIG. 12 is a flow-chart diagram of a method embodiment under the present disclosure.

FIG. 12 displays a method embodiment 1200 for constructing a wing for an aircraft under the present disclosure. At step 1210, a wing spar is provided. At 1220, ribs are provided that connect to the spar. At 1240 a plurality of antenna surfaces are provided fore of the spar. At 1250, a plurality of antennas is attached to the plurality of antenna surfaces. A similar method embodiment to method 1100 can be carried out for a trailing edge antenna structure.

Figure 13:
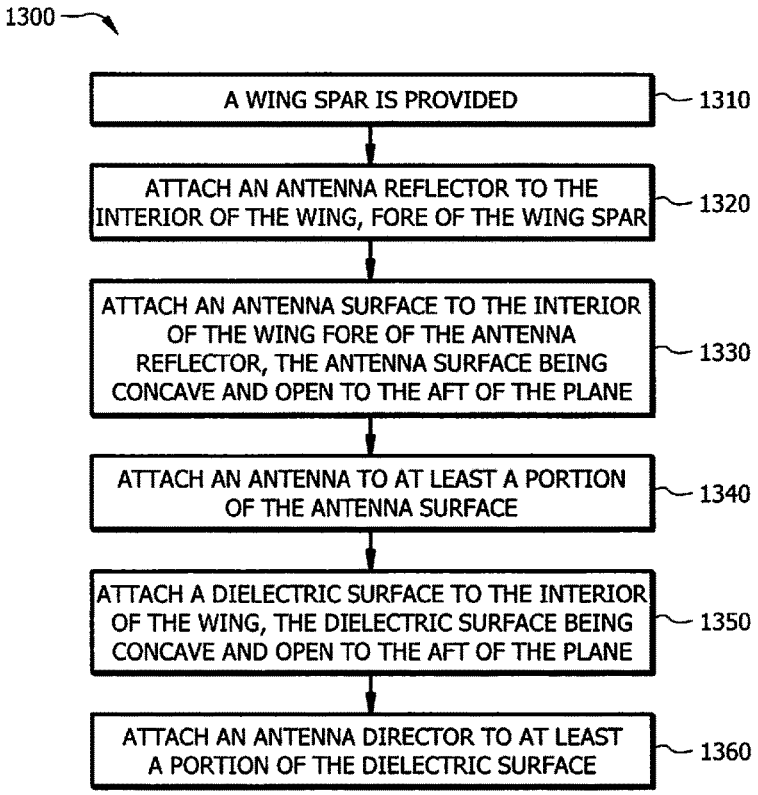
FIG. 13 is a flow-chart diagram of a method embodiment under the present disclosure.

FIG. 13 displays a further possible method embodiment under the present disclosure. Method 1300 comprises a method for constructing a leading edge antenna structure on a wing of an aircraft. At 1310, a wing spar is provided interior to the wing. At 1320, an antenna reflector is attached to the interior of the wing on the fore side of the wing spar. At 1330, an antenna surface is attached to the interior of the wing on the fore side of the antenna reflector, the antenna surface having a concave shape open toward the aft of the aircraft. At 1340, an antenna is attached to at least a portion of the antenna surface. At 1350, a dielectric surface is attached to the interior of the wing on the fore side of the antenna surface, the dielectric surface having a concave shape open toward the aft of the aircraft. At 1360, an antenna director is attached to at least a portion of the dielectric surface.

Figure 14A:
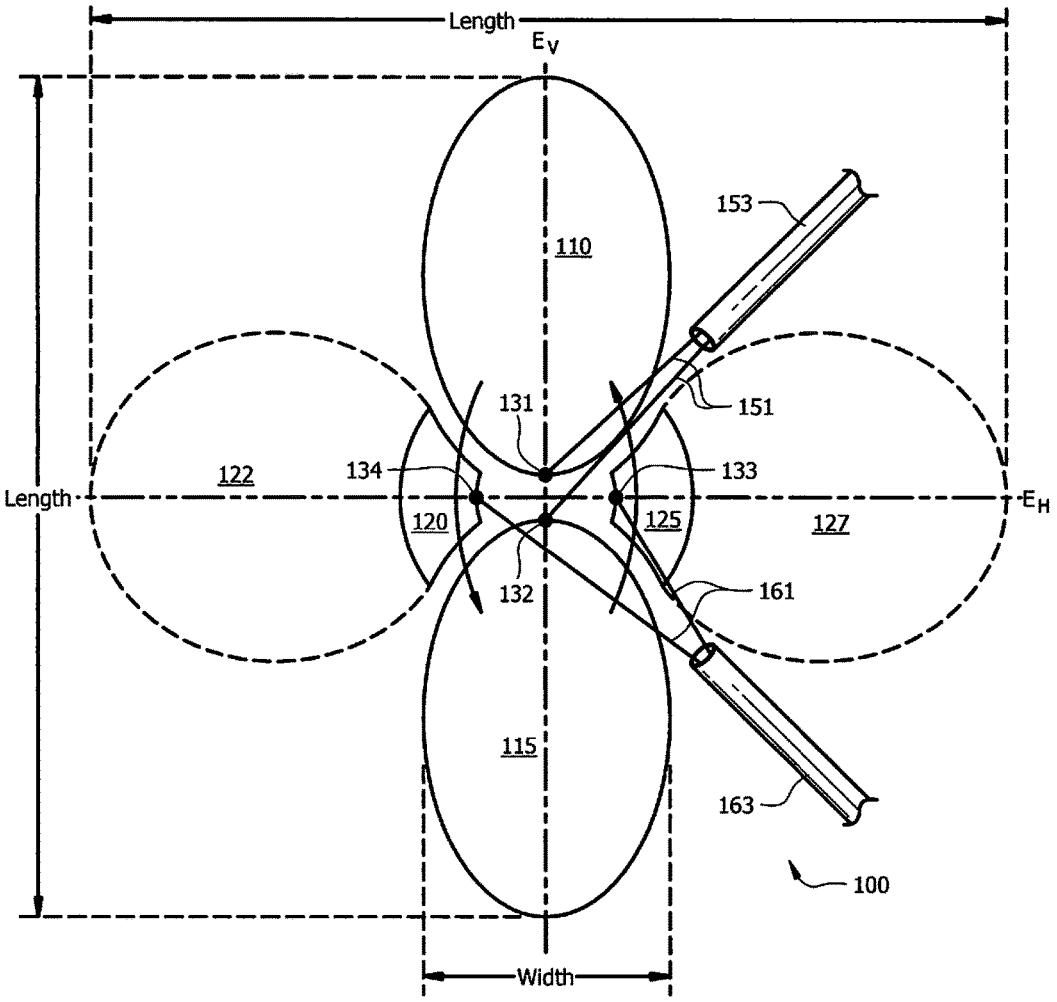
FIGS. 14A-14M display diagrams of antenna embodiments under the present disclosure.
Figure 14B:
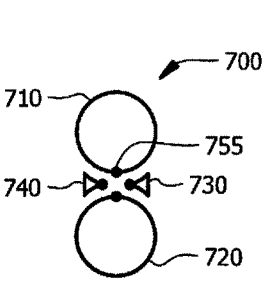
Figure 14C:
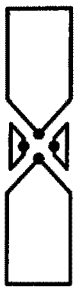
Figure 14D:
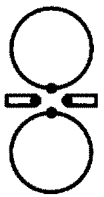
Figure 14E:
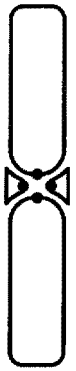
Figure 14F:
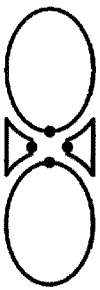
Figure 14G:
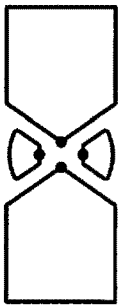
Figure 14H:
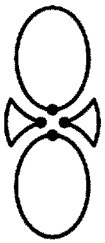
Figure 14I:
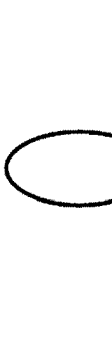
Figure 14J:
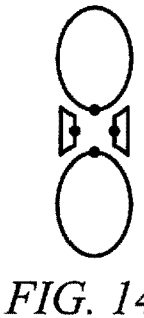
Figure 14K:
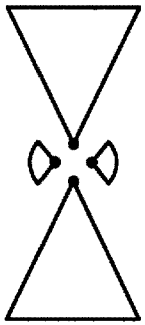
Figure 14L:
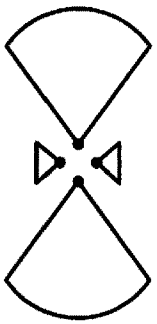
Figure 14M:
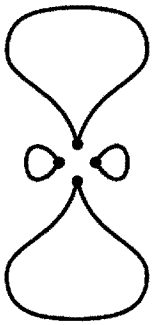

FIGS. 14A-14M display possible antennas that may be used under the present disclosure and the embodiments described. Referring to FIG. 14A, one embodiment of a dual polarization antenna 100 under the current disclosure is shown. Antenna 100 comprises legs 110, 115 with feeds 131, 132, and what look like parasitic elements. However, side legs 120, 125, have feeds 133, 134. This allows the antenna to achieve dual polarization. Vertical polarization can be achieved by the current flowing up and down legs 110, 115. The current from side leg 120 to side leg 125 and back, yields a horizontal polarization. Side legs 120, 125 function as both legs and parasitics. Antenna 100 has a variety of advantages. It is single layer and therefore simple to employ, cost effective, and lightweight. The antenna 100 can be conformal to a surface. Antennas under the present disclosure, such as antenna 100, can comprise a single layer of copper, achieving great economic efficiencies. The dual polarization enables resonance at a much lower frequency. The antenna 100 also is very wideband. Feeds 151 (for elements 110, 115, connected to cable 153) and feeds 161 (for elements 120, 125, connected to cable 163) are illustrative of any type of feed or cabling, and merely serve to illustrate one embodiment. Antennas under the present disclosure also provide very low mutual coupling between the legs and parasitics. FIGS. 14B-14M shows various embodiments of dual polarization antennas 700 under the present disclosure. Each antenna 700 comprises two legs 710, 720, two parasitic/legs 730, 740, and four feeds 755. As shown, dual polarization antennas under the present disclosure can take a variety of shapes and sizes. The optional height-to-width ratio is 3:1 to 4:1 (height comprising a tip-to-tip measurement of the legs, width measuring a tip-to-tip measurement of the parasitics). But operational geometries can run up to 5:1, even to 15:1. Ratios of 1:1 can also be functional. As shown in FIGS. 14K-14M, the legs of antennas under the present disclosure can also comprise planar inverted cone antennas. The variously shaped legs and parasitics of FIGS. 14A-14M can be combined in any variety of combinations, such that various shapes of different components can be used.

Figure 15:
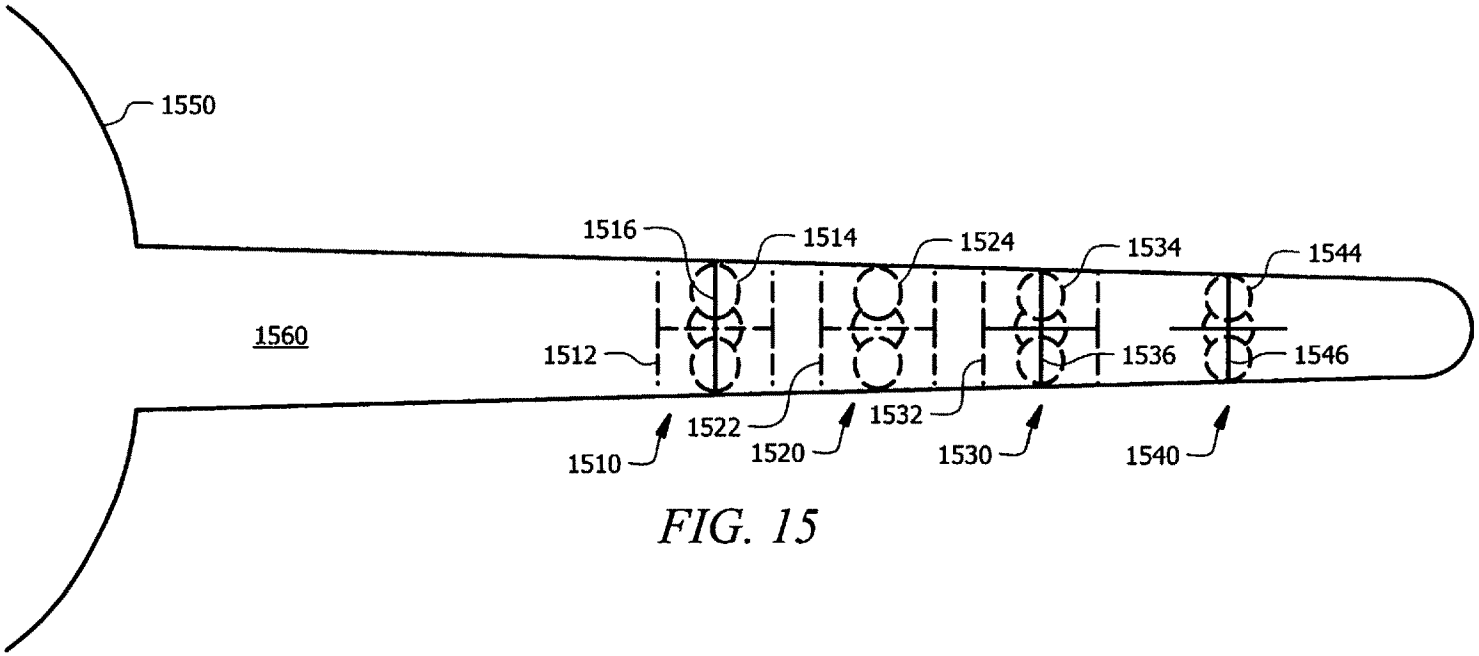
FIG. 15 displays possible antenna structure embodiments under the present disclosure.

FIG. 15 shows diagrams of possible antenna structure embodiments as seen from the front of the plane. Aircraft 1550 has a wing 1560 with antenna structures 1510, 1520, 1530, and 1540. Other wing embodiments can comprise a single antenna structure, several structures, or many structures, as well as different types of directors, antennas and reflectors, such as different shapes and sizes, or different types of antennas. In FIG. 15 each structure is different, however various embodiments can comprise a plurality of identical structures, or various different structures. Antenna structure 1510 comprises a vertical director 1516, a reflector 1512, and an antenna 1514. Antenna structure 1520 comprises a reflector 1522 and an antenna 1524. Antenna structure 1530 comprises a cross-shaped director 1536, a reflector 1532, and an antenna 1534. Antenna structure 1540 comprises a cross-shaped director 1546 and an antenna 1544. In some embodiments, a portion of the antenna structure can reside on the leading surface of the wing. In other embodiments all portions of the antenna structure can reside behind the leading surface of the wing.

Embodiments under the present disclosure can comprise multiple directors on a leading edge. Such an embodiment can be seen in FIG. 16. Wing 1600 comprises spar (or other components such as gas tanks) at 1650 and a trailing edge 1651. Trailing edge can optionally comprise various antenna structures (antennas, directors, reflectors) as described herein. Wing 1600 also comprises directors 1655, 1645, and 1630 on director surfaces 1635, 1625, and 1615 respectively. Each director 1655, 1645, 1630 is in front of antenna 1640 and antenna driver 1642 on antenna surface 1605. Reflector 1610 is across space 1660 from antenna surface 1605. Space

1670 separates antenna surface 1605 from director surface 1615. Space 1680 separates director surface 1615 from director surface 1625. Space 1690 separates director surface 1625 from director surface 1635. More director surfaces can be used as well. A trailing edge can comprise similar embodiments with multiple directors. Any number of directors can be implemented on leading or trailing edges in the manners described.

Figure 16:
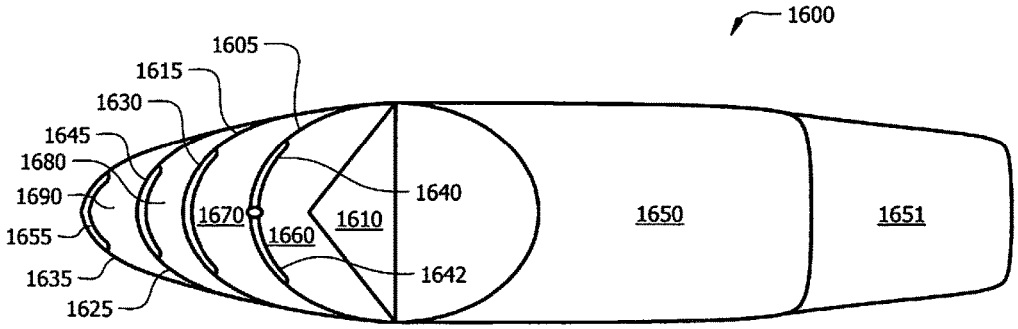
FIG. 16 displays possible antenna structure embodiments under the present disclosure.

Multiple directors, such as those in FIG. 16, integrate aspects of Yagi-Uda ("YU") antennas, commonly seen as television antennas. In YU antennas the directors tend to be separated by approximately ¼λ. But this distance can be adjusted, and for wideband antennas it can be hard to measure. Directors in YU antennas, and in some embodiments under the present disclosure, can narrow beam width while increasing gain. In most embodiments, such as that shown in FIG. 16, as directors are added, each more forward director (i.e. further from driver on antenna) will decrease slightly in size.

Figure 17:
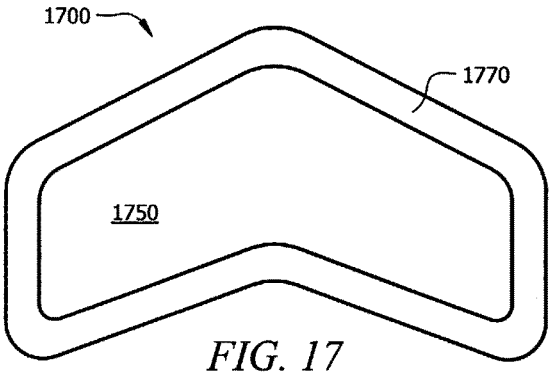
FIG. 17 displays a possible wing embodiment under the present disclosure.

FIG. 17 shows a possible embodiment of a top view of a wing 1700 under the present disclosure. Spar 1750 can comprise gas tanks and other wing support structures. Spar 1750 will typically comprise metal or carbon fiber. On the edges of the spar 1750 are dielectric surfaces 1770. Dielectric surface 1770 can surround all of the spar 1750, substantially all of spar 1750, or just a portion of spar 1750. In most embodiments dielectric surface 1770 will surround the lateral, front, and back edges of spar 1750, but not the top and bottom surfaces. However, some embodiments can implement dielectric on top and bottom portions of spar 1750. Furthermore, as mentioned above, some aircraft can be implemented comprising all dielectric surfaces. The present disclosure can be applied to any dielectric surface embodiment.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An aircraft wing comprising:
- a spar;
- an antenna reflector located forward of the spar and extending away from the spar;
- an antenna surface located forward of the antenna reflector and extending away from the antenna reflector;
- an antenna attached to the antenna surface and substantially conformal to the antenna surface;
- a dielectric surface located forward of the antenna surface and extending away from the antenna surface; and
- an antenna director attached to the dielectric surface and substantially conformal to the dielectric surface.

2. The aircraft wing of claim 1 wherein the antenna is a dual pol antenna.

3. The aircraft wing of claim 1 wherein the reflector comprises a metal.

4. The aircraft wing of claim 1 wherein the antenna reflector and antenna director increase the gain of the wing.

5. The aircraft wing of claim 1 further comprising one or more antennas on the top of the wing and one or more antennas on the bottom of the antenna.

6. The aircraft wing of claim 5 wherein the antennas on the top and bottom of the wing are proximate the antenna.

7. The aircraft wing of claim 5 wherein the antennas on the top and bottom of the wing are distal the antenna.

8. The aircraft wing of claim 1 further comprising a de-icing cavity between the dielectric surface and the antenna surface.

9. An aircraft wing comprising:
- a spar;
- a leading edge antenna structure comprising;
  - a first antenna reflector located forward of the spar and extending away from the spar;
  - a first antenna surface located forward of the first antenna reflector and extending away from the antenna reflector;
  - a first antenna attached to the first antenna surface and substantially conformal to the first antenna surface;
  - a first dielectric surface located forward of the first antenna surface and extending away from the first antenna surface; and
  - a first antenna director attached to the first dielectric surface and substantially conformal to the first dielectric surface; and
- a trailing edge antenna structure comprising;
  - a second antenna reflector located aft of the spar and extending away from the spar;
  - a second antenna surface located aft of the second antenna reflector and extending away from the second antenna reflector;
  - a second antenna attached to the second antenna surface and substantially conformal to the second antenna surface;
  - a second dielectric surface located aft of the second antenna surface and extending away from the second antenna surface; and
  - a second antenna director attached to the second dielectric surface and substantially conformal to the second dielectric surface.

10. The aircraft wing of claim 9 wherein the first dielectric surface is substantially contiguous with the front of the wing.

11. The aircraft wing of claim 9 wherein the first and second antenna reflectors comprise metal.

12. The aircraft wing of claim 9 wherein the first antenna reflector and first director increase the gain of the first antenna and the second antenna reflector and second director increase the gain of the second antenna.

13. The aircraft wing of claim 9 further comprising one or more antennas on the top of the wing and one or more antennas on the bottom of the wing.

14. The aircraft wing of claim 9 further comprising:
- one or more power amplifiers aft of the first antenna reflector; and
- one or more cavities for cable routing aft of the first antenna reflector.

15. The aircraft wing of claim 9 further comprising a cavity for fuel storage that is aft of the first antenna reflector and fore of the second antenna reflector.

16. The aircraft wing of claim 9 wherein at least a portion of the exterior of the wing comprises a radiation absorbent material.

17. A leading edge antenna structure on a wing of an aircraft comprising:

a wing spar interior to the wing;

an antenna reflector on the interior of the wing on the fore side of the wing spar;

an antenna surface on the interior of the wing on the fore side of the antenna reflector, the antenna surface having a concave shape open toward the aft of the aircraft;

an antenna on at least a portion of the antenna surface;

a dielectric surface on the interior of the wing on the fore side of the antenna surface, the dielectric surface having a concave shape open toward the aft of the aircraft; and an antenna director on at least a portion of the dielectric surface.

18. The leading edge antenna structure of claim 17 wherein the antenna surface is dielectric.

19. The leading edge antenna structure of claim 17 further comprising a first conformal antenna on the top of the wing and a second conformal antenna on the bottom of the wing.

20. The leading edge antenna structure of claim 17 wherein the antenna reflector is substantially triangle shaped.

* * * * *